US008833673B2

(12) United States Patent
Miracle

(10) Patent No.: US 8,833,673 B2
(45) Date of Patent: Sep. 16, 2014

(54) STRAW FOR DISPENSING FLUIDS

(71) Applicant: Dawn Martha Miracle, Denver, CO (US)

(72) Inventor: Dawn Martha Miracle, Denver, CO (US)

( * ) Notice: Subject to any disclaimer, the term of this patent is extended or adjusted under 35 U.S.C. 154(b) by 191 days.

(21) Appl. No.: 13/621,856

(22) Filed: Sep. 18, 2012

(65) Prior Publication Data

US 2013/0068854 A1 Mar. 21, 2013

Related U.S. Application Data

(60) Provisional application No. 61/536,800, filed on Sep. 20, 2011.

(51) Int. Cl.
*A47G 21/18* (2006.01)
*A61J 15/00* (2006.01)

(52) U.S. Cl.
CPC ..... *A47G 21/18* (2013.01)
USPC ..... 239/33; 239/597; 239/599; 239/601; D7/300.2

(58) Field of Classification Search
CPC ... A47G 21/18; A47G 21/182; A47G 21/185; A47G 21/187; A47G 21/188
USPC ..... 239/12, 33, 601, 597, 599; 215/229, 215/388, 389; 220/705–710; D7/300.2
See application file for complete search history.

(56) References Cited

U.S. PATENT DOCUMENTS

| | | | | | |
|---|---|---|---|---|---|
| 1,223,933 | A | * | 4/1917 | Carr | 138/177 |
| 2,036,773 | A | * | 4/1936 | Prudden | 138/128 |
| 2,815,981 | A | | 12/1957 | Nonnamaker et al. | |
| 3,780,944 | A | * | 12/1973 | Zubalik | 239/33 |
| 4,726,518 | A | * | 2/1988 | Martina et al. | 239/33 |
| 4,883,187 | A | | 11/1989 | Knitzer | |
| 5,025,947 | A | * | 6/1991 | Leone | 220/229 |
| 5,039,012 | A | * | 8/1991 | Inaba | 239/33 |
| 5,335,851 | A | | 8/1994 | Adaska et al. | |
| 5,427,316 | A | * | 6/1995 | Leone | 239/33 |
| 6,234,342 | B1 | | 5/2001 | Cornell et al. | |
| 6,929,135 | B1 | | 8/2005 | Hajianpour | |
| 7,537,173 | B1 | | 5/2009 | Kogan | |
| 7,584,900 | B2 | | 9/2009 | White et al. | |
| 7,789,320 | B1 | | 9/2010 | Schwartz | |
| 8,231,067 | B1 | | 7/2012 | Robinson | |
| 2002/0030115 | A1 | * | 3/2002 | Float et al. | 239/33 |
| 2003/0006293 | A1 | * | 1/2003 | Lee | 239/33 |
| 2004/0089629 | A1 | | 5/2004 | Villaescusa et al. | |

* cited by examiner

*Primary Examiner* — Darren W Gorman
(74) *Attorney, Agent, or Firm* — Peter J. Rashid

(57) ABSTRACT

A straw for dispensing fluids includes a first end, a second end opposite the first end, an outer surface, and at least one aperture extending from the first end to the second end defining an inner surface. The aperture has a non-circular cross-sectional shape, such as an oval, an ellipse, a tear drop, and the like. The straw is made of a durable, non-toxic material, such as thermoplastic material that is suitable to withstand a temperature of the fluid of up to 212 degrees Fahrenheit, while preventing toxin release related to common cold beverage straws when immersed in hot beverages.

10 Claims, 1 Drawing Sheet

STRAW FOR DISPENSING FLUIDS

CLAIM TO PRIORITY

This application claims the benefit of U.S. Provisional Application Ser. No. 61/536,800, filed Sep. 20, 2011, the entire contents of which are incorporated herein by reference.

BACKGROUND OF THE INVENTION

1. Field of the Invention

This invention relates to a straw for dispensing fluids, and in particular, to a drinking straw for dispensing hot liquids, such as coffee, tea, apple cider, and the like, having an aperture with a non-circular cross-sectional shape, such as an oval, ellipse, and the like. The straw prevents coffee stains on teeth, kids and adults from spilling their drinks, allows the ability to drink coffee while driving and allows people with tremor, shaky hands, braces or recent mouth surgery to easily drink a hot beverage.

2. Description of Related Art

Various configurations of individual beverage receptacles, such as beverage bottles, cans, to-go coffee cups, travel mugs, and cartons, each having a top-side opening for direct dispensing or for accommodating a drinking straw. The top-side opening may be concentric with or offset from a central top-surface opening provided in the top surface of square or rectangular beverage containers. In any such configuration, a drinking straw may be inserted into the top-side opening and projected into the contents therein to extract by sucking a desired volume of contents from the container, the straw remaining loosely positioned within the periphery of the top-side opening. Straws used in this manner are typically provided separately and apart from the beverage receptacle. In other configurations, the drinking straw may be provided in a separate sealed plastic envelope, optionally affixed to the beverage receptacle.

Unfortunately, conventional straws do not work well for drinking hot liquids. Conventional straws are not made of a suitable material that can withstand the temperature of hot liquids, such as coffee, tea, and the like. As a result, toxic substances, such as plasticizers, BPA, and the like, may be released from the straw into the liquid when passing through the straw. In addition, the straw remains loosely positioned within the top-side opening of the lid of the beverage receptacle. As a result, spills of the hot liquid are common during use.

BRIEF SUMMARY OF THE INVENTION

Briefly, according to an aspect of the invention, the problem of providing a drinking straw suitable for hot liquids is solved by providing a straw made of thermoplastic material, such as polypropylene, polyethylene, and the like. The problem of preventing spills is solved by providing a straw having an aperture with a non-circular cross-sectional shape, such as an oval, ellipse, and the like.

The straw of the invention has many benefits. The straw of the invention is adapted to match the design of any and all commercially produced hot beverage lid/cap/top drink openings. This feature is in direct contrast to the common drinking straw which commonly remains loosely positioned within the top-side opening of the lid of the beverage receptacle. As a result, spills of the hot liquid during use of common straws, are eliminated.

The straw of the invention is made of materials that are highly immune to temperatures up to and including 100 degrees Celsius or 212 degrees Fahrenheit, such as polypropylene, polyethylene, glass, ceramic and the like, in that the materials used are designed to prevent toxins, such as plasticizers, Bisphenol A (BPA), and the like, from leeching into the hot liquid.

The straw of the invention prevents dental damage and tooth discoloration. The delivery of the fluid by positioning the proximal end of the straw, distally away from the back of the teeth thereby eliminating the coating of tooth enamel with enamel destroying sugars and enamel staining common to the consumption of darkly colored beverages such as but not limited to coffee and teas, benefits all people, especially those with recent dental whitening procedures, braces or mouth surgery.

The straw of the invention allows people to drink hot liquids and have virtually all the harmful contents that may be present in the hot liquid, such as stains, sugar, and the like, to bypass their teeth when the person drinks the hot liquid. In addition, the straw of the invention prevents spills and allow small children and adults with any medical problems that result in shaky hands to drink hot liquids without any difficulty.

The straw of the invention prevents distracted driving. It is a fact of life that people consumes beverages while driving. It has been noted that law enforcement officers often use straws in their coffee so that they can keep their eyes on the road as should all persons driving safely, focusing their full attention on the road while drinking hot beverages.

The straw of the invention aids those afflicted with: Old Age, Parkinson's, Neurological Disorders, Essential Tremors, Dementia, Hypoglycemia, Anxiety, various Medications, Thyroid Disorders, Dyskinesia or any other problems that cause their hands to shake.

The straw of the invention prevents stains to clothing and automotive interiors due to unnecessary common spillage as beverage cups are necessarily tilted to begin consumption of beverages.

The straw of the invention prevents unnecessary waste by promoting green usage, reducing the current 35 million pounds of drinking straws entering our landfills and reducing the current usage of 22 billion disposable straws per year and the petroleum needed in their manufacture and distribution.

The straw of the invention preserves the lipstick normally lost in direct contact during consumption from hot beverage containers and further prevents the staining of beverage containers with lipstick.

In summary, the straw of the invention is particularly suited for: 1) people who whiten their teeth, 2) people who want to prevent stains and sugar from getting on their teeth, 3) people who multi-task and don't want to worry about spilling coffee, 4) children, 5) people with tremor, dyskinesia or any other problems that cause their hands to shake, 6) people with braces or recent mouth surgery, and 7) people who drive a lot and want to keep their full attention on the road while drinking coffee.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 3:
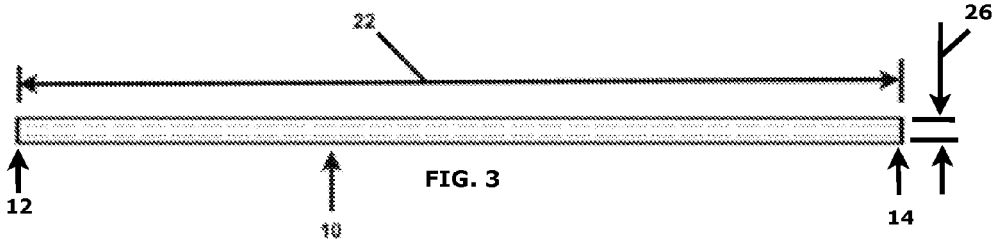
FIG. 3 is another side view of the straw of FIG. 1.

Referring now to FIGS. 1-4, a straw, shown generally at 10, for dispensing hot liquids is shown according to an embodiment of the invention. In the embodiment, the straw 10 includes a first end 12, a second end 14, an outer surface 16, and at least one aperture 18 extending from the first end 12 to the second end 14 and defining an inner surface 20. As used herein, hot liquids shall mean any fluid that is heated to a temperature of at least 110 degrees Fahrenheit (43.33 degrees Celsius) to a maximum of 212 degrees Fahrenheit (100.0 degrees Celsius).

In the illustrated embodiment, the straw 10 has a length 22 (in the y-direction), a width 24 (in the x-direction), a depth 26 (in the z-direction), and a thickness 28 between the outer surface 16 and the inner surface 20. In one embodiment, for example, the straw 10 has a length 22 of about 7.10 inches (180.34 mm), a width 24 of about 0.430 inches (10.922 mm), a depth 26 of about 0.170 inches (4.318 mm), and a thickness 28 of about 0.030 inches (0.762 mm). It will be appreciated that the invention is not limited by the dimensions of the straw 10, and that the invention can be practiced with any desirable dimensions. For example, the dimensions of the straw 10 can be adapted to be suitable for a particular size of beverage container, size of the opening in the cap of the beverage container, and the like. The straw 10 can be manufactured using well-known methods, such as extrusion, and the like.

Figure 1:
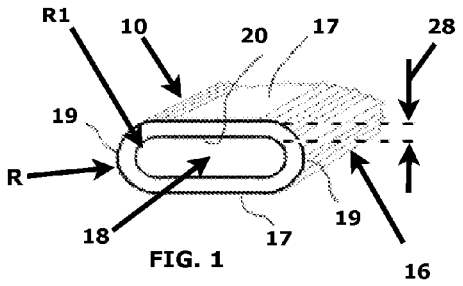
FIG. 1 is an end perspective view of a straw for dispensing hot liquids according to an embodiment of the invention.

As shown in FIG. 1, one aspect of the invention is that the outer surface 16 of the straw 10 is non-circular in cross-sectional shape defined by a pair of opposing side walls 17 and end walls 19 having an outer radius, R. In the illustrated embodiment, the outer radius, R, is equal to about 0.097. In addition, the aperture 18 of the straw 10 is non-circular in cross-sectional shape having an inner radius, R1. It will be appreciated that the aperture 18 can be any desirable non-circular cross-sectional shape, such as oval, elliptical, and the like. In the illustrated embodiment, the inner radius, R1, is approximately equal to about 0.068. The aperture 18 is of sufficient size to ensure that heat dissipation occurs and the fluid will slightly cool so that the fluid will be at a safe temperature to drink. It will be appreciated that the invention is not limited by the dimension or configuration of the aperture 18, and that the invention can be practiced with any desirable aperture dimension or configuration.

The straw 10 of the invention has a substantially constant thickness 28 of about 0.030 inches (0.762 mm), which is greater than conventional straws. However, various internal support stiffeners can be used to minimize the amount of material, while maintaining sufficient strength to allow the straw 10 to be reusable. The straw 10 is made of durable, non-toxic material. For example, the straw 10 can be made of glass, ceramic, non-toxic metals, and the like. In another example, the straw 10 can be made of a thermoplastic polymer material, such as polypropylene, polyethylene, terephthalates, polymethacrylate, flexible polycarbonate, and high density polystyrene, and the like. Polypropylene has a melting temperature of 266 degrees Fahrenheit (130 degrees Celsius), and polyethylene has a melting temperature of between about 221 to about 239 degrees Fahrenheit (105 to 115 degrees Celsius). As a result, the straw 10 can safely withstand hot liquids having a temperature of up to 200 degrees Fahrenheit. Most hot liquids, for example, hot coffee is served at a temperature of about 170 degrees Fahrenheit, so the straw 10 of the invention is safe for hot coffee, and the like. Unlike conventional straws that are widely used by people, the straw 10 of the invention does not release plasticizers into the hot liquid and is completely free of Bisphenol A (BPA).

Figure 4:
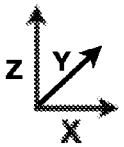
FIG. 4 is a perspective view of the straw of FIG. 1 partially inserted into a top-side opening of a beverage receptacle.
Figure 4:
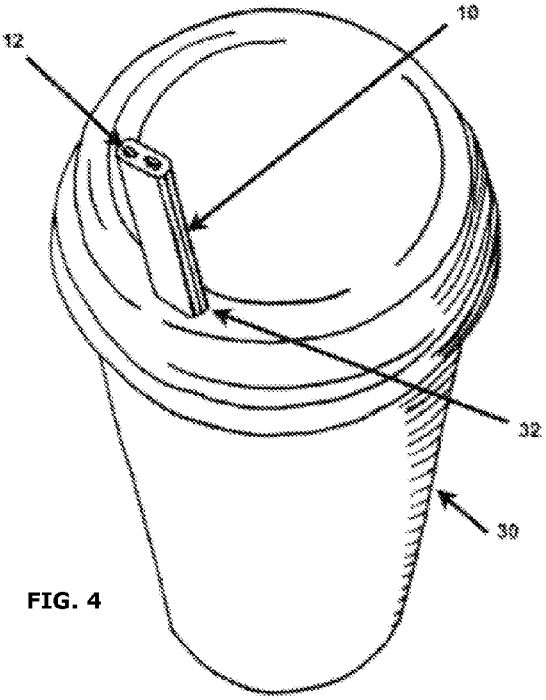
Figure 2:
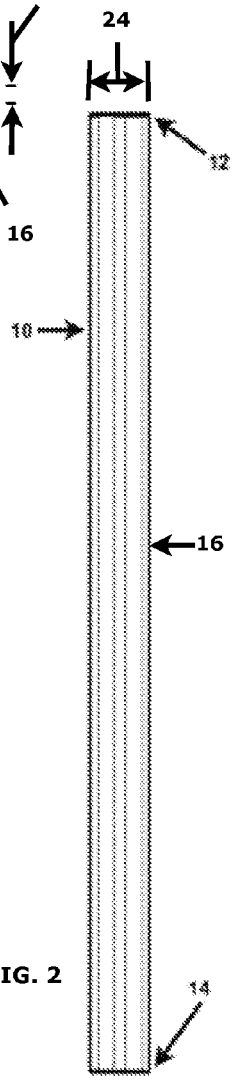
FIG. 2 is a side view of the straw of FIG. 1.

As shown in FIG. 4, the straw 10 of the invention snugly fits into the opening in the lid 32 (i.e., to-go lid) of the beverage receptacle 30, unlike conventional straws that fit loosely into the opening in the lid. The placement of the end 12, 14 of the straw 10 that is taken into the mouth is distal to the rear of the Maxillary and Mandibular Central Incisors, which is comfortable and natural. The placement also allows people to drink hot liquids and have virtually all the harmful contents that may be present in the hot liquid to bypass their teeth. In addition, the straw 10 of the invention prevents spills and allows small children and adults with any medical problems that result in shaky hands to drink hot liquids without any difficulty.

Figure 5:
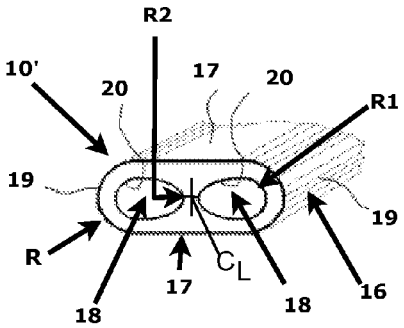
FIG. 5 is an end perspective view of a straw for dispensing hot liquids according to another embodiment of the invention.

Referring now to FIG. 5, a straw 10' is shown according to another embodiment of the invention. The straw 10' is substantially identical to the straw 10, except that the straw 10' includes two non-circular apertures 18. The apertures 18 can be any desirable non-circular cross-sectional shape, such as oval, elliptical, and the like. In this illustrated embodiment, the non-circular apertures 18 are substantially tear drop in cross-sectional shape having an outer radius, R, and a first inner radius, R1, and a second inner radius, R2. In the illustrated embodiment, the outer radius, R, is equal to about 0.097, and the first inner radius, R1, is approximately equal to about 0.068, and the second inner radius, R2, is approximately equal to about 0.038. As shown in FIG. 5, the first inner radius, R1, of each aperture 18 are proximate each other such that the second inner radius, R2, of each aperture 18 is closer to a central, longitudinal axis, $C_L$, than the first inner radius, R1.

The straw 10, 10' has many advantages as compared to conventional straws. The straw 10 would be purchased by a consumer in the same way a drinking glass or beverage mug would be, with the intent that this item would be used over and over again. Commonly, while some are not, hot beverage are typically purchased to be transported and consumed simultaneously. The straw 10, 10' would be inserted into the matching beverage consumption opening in the lid/cover/cap of the beverage container. Practically, this opening appears to be an ideally suited, oval or ellipse in shape and dimensions, that have very little variance between commercial manufacturers. Upon insertion of the straw 10, 10', this common opening is snugly sealed, whereupon the benefits of the invention become apparent. The consumer of the beverage is no longer required to tip the container to access the hot fluids, the container remains perfectly level. The consumer is therefore protected from common leaks between the container and the lid, and the ensuing stains to clothing and property and the more dangerous 1st and 2nd degree burns. Often these beverages are delivered via fast food drive through windows and the driver is expected to immediately move their vehicle forward without the opportunity to insure the seal of the cover to container was complete. The straw 10, 10' encourages the driving consumer to pull forward, inspect the seal and further seal the beverage delivery system with the straw 10, 10', creating a very forgiving hot beverage delivery system that no longer needs to be tipped, no longer needs to be a distraction to driving because the straw protrudes in a significant way, negating the need to "find" the opening, or rotate the opening properly, bring the opening to lips and then necessarily tilt the container significantly and then as fluid is consumed, tilt more dramatically and dangerously in order to continue consumption. The sealing and tilt prevention of the straw 10, 10' is critical to the prevention of burns, clothing, upholstery, carpet and the like as well as reduction of auto accidents—citing various studies done by AAA, by Network of Employers for Traffic Safety (NETS) and the Australian AMTA, on average, 71.4% of drivers eat and/or drink while driving and that contrary to popular belief, spilled hot coffee on yourself and dropping something on the floor while driving are two of the distractions drivers cited most frequently as reasons for road traffic accidents.

The straw 10, 10' of the invention is particularly suited for: 1) people who whiten their teeth, 2) people who want to prevent stains and sugar from getting on their teeth, 3) people who multi-task and don't want to worry about spilling coffee, 4) children, 5) people with tremor, dyskinesia or any other problems that cause their hands to shake, 6) people with braces or recent mouth surgery, and 7) people who drive a lot and want to keep their full attention on the road while drinking coffee.

The documents, patents and patent applications referred to herein are hereby incorporated by reference.

While the invention has been specifically described in connection with certain specific embodiments thereof, it is to be understood that this is by way of illustration and not of limitation, and the scope of the appended claims should be construed as broadly as the prior art will permit.

What is claimed is:

1. A straw for dispensing fluids, comprising:

a first end;

a second end opposite the first end;

an outer surface having a non-circular cross-sectional shape defined by a pair of opposing side walls and end walls having an outer radius, R; and two non-circular apertures extending from the first end to the second end, each aperture defining an inner surface having a tear drop shape with a first inner radius, R1, and a second inner radius, R2, wherein the first inner radius, R1, is larger than the second inner radius, R2, and wherein the second inner radius, R2 of each aperture are proximate each other.

2. The straw according to claim 1, wherein the non-circular cross-sectional shape of the outer surface comprises an oval shape.

3. The straw according to claim 1, wherein the straw is made of non-toxic material.

4. The straw according to claim 3, wherein the non-toxic material comprises a thermoplastic or thermosetting material, glass, ceramic, and non-toxic metal.

5. The straw according to claim 4, wherein the thermoplastic or thermosetting material comprises polypropylene, polyethylene, terephthalates, polymethacrylate, flexible polycarbonate, and high density polystyrene.

6. A straw for dispensing fluids, comprising:

a first end;

a second end opposite the first end;

an outer surface having a non-circular cross-sectional shape defined by a pair of opposing side walls and end walls having an outer radius, R; and two non-circular apertures extending from the first end to the second end, each aperture defining an inner surface having a tear drop shape with a first inner radius, R1, and a second inner radius, R2, wherein the first inner radius, R1, is larger than the second inner radius, R2, and wherein the second inner radius, R2 of each aperture is closer to a central, longitudinal axis, $C_L$, than the first inner radius, R1.

7. The straw according to claim 6, wherein the non-circular cross-sectional shape of the outer surface comprises an oval shape.

8. The straw according to claim 6, wherein the straw is made of non-toxic material.

9. The straw according to claim 8, wherein the non-toxic material comprises a thermoplastic or thermosetting material, glass, ceramic, and non-toxic metal.

10. The straw according to claim 9, wherein the thermoplastic or thermosetting material comprises polypropylene, polyethylene, terephthalates, polymethacrylate, flexible polycarbonate, and high density polystyrene.

* * * * *